US010663181B2

(12) United States Patent
Meng et al.

(10) Patent No.: US 10,663,181 B2
(45) **Date of Patent: *May 26, 2020**

(54) AC CAGE ANTI-THEFT DEVICE AND METHOD OF USE

(71) Applicants: Xianbin Meng, Tampa, FL (US); Peter Yuanbao Meng, Tampa, FL (US); Patrick Y. Meng, Tampa, FL (US)

(72) Inventors: Xianbin Meng, Tampa, FL (US); Peter Yuanbao Meng, Tampa, FL (US); Patrick Y. Meng, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/576,002

(22) Filed: Sep. 19, 2019

(65) Prior Publication Data

US 2020/0011548 A1 Jan. 9, 2020

Related U.S. Application Data

(63) Continuation of application No. 15/530,466, filed on Jan. 19, 2017, now Pat. No. 10,458,663.

(30) Foreign Application Priority Data

Jan. 20, 2016 (WO) ..... PCTCN2016071454

(51) Int. Cl.
*F24F 1/58* (2011.01)
*E05B 73/00* (2006.01)

(52) U.S. Cl.
CPC ..... *F24F 1/58* (2013.01); *E05B 73/00* (2013.01); *F24F 2221/44* (2013.01)

(58) Field of Classification Search
CPC ..... F24F 1/58; F24F 2221/44; E04H 17/18
USPC ..... 403/109.1–109.8; 256/25, 26
See application file for complete search history.

(56) References Cited

U.S. PATENT DOCUMENTS 2,011,528 A * 8/1935 Seay ..... A47C 4/06 256/26
2,611,909 A * 9/1952 Dillon ..... A61G 7/0518 5/426
5,282,606 A * 2/1994 Praiss ..... E04H 4/06 160/135
5,622,198 A * 4/1997 Elsinger ..... E04H 15/48 135/128
5,704,164 A * 1/1998 Huang ..... E06B 9/02 160/372

(Continued)

*Primary Examiner* — Joshua T Kennedy
(74) *Attorney, Agent, or Firm* — Nicholas Pfeifer; Smith & Hopen, P.A.

(57) ABSTRACT

An anti-theft device having at least three side surrounding frames in series, each having an adjustable width. The first side surrounding frame has a first free end and a second end rotatably secured to a first end of a second side surrounding frame. The second end of the second side surrounding frame is rotatably secured to a first end of a third side surrounding. The second end of the third side surrounding frame or the second end of the last side surrounding frame is a free end. When the anti-theft device is in a folded state, the at least three side surrounding frames stack on each other with the rotatably secured ends of the various side surrounding frames remaining rotatably secured to each other. The device is arranged around an AC unit and two free ends lock together to enclose the AC unit within the plurality of side surrounding frames.

18 Claims, 7 Drawing Sheets

(56) References Cited

U.S. PATENT DOCUMENTS

| | | | | |
|---|---|---|---|---|
| 6,725,808 | B2 * | 4/2004 | Campbell | A01K 3/00 119/512 |
| 7,836,653 | B1 * | 11/2010 | Herrington | F24F 1/58 256/25 |
| 8,505,182 | B2 * | 8/2013 | Kuhn | B65F 1/1426 29/428 |
| 8,596,015 | B2 * | 12/2013 | Coon | E05B 73/00 248/354.1 |
| 8,677,790 | B2 * | 3/2014 | Ramsey | F24F 1/56 109/49.5 |
| 10,174,956 | B2 * | 1/2019 | Stanton | F24F 1/58 |
| 2003/0146426 | A1 * | 8/2003 | Ray | A01K 3/00 256/59 |
| 2008/0185566 | A1 * | 8/2008 | Flannery | E06B 9/06 256/73 |
| 2014/0232249 | A1 * | 8/2014 | White | F24F 1/58 312/215 |
| 2016/0047141 | A1 * | 2/2016 | Juett | E04H 17/18 256/25 |

* cited by examiner

AC CAGE ANTI-THEFT DEVICE AND METHOD OF USE

CROSS-REFERENCE TO RELATED APPLICATIONS

This nonprovisional application is a continuation of and claims priority to nonprovisional application Ser. No. 15/530,466, now issued as U.S. Pat. No. 10,458,663, entitled "AC CAGE ANTI-THEFT DEVICE," filed Jan. 19, 2017 by the same inventors.

BACKGROUND OF THE INVENTION

1. Field of the Invention

This invention relates to anti-theft devices.

2. Brief Description of the Prior Art

At present, an anti-theft device is usually employed for enclosing an outdoor air conditioner unit. The anti-theft device may employ a wire entanglement and/or a surrounding frame. However, the size of outdoor air conditioner units vary, resulting in the production of many different anti-theft devices of varying sizes.

In the prior art, an anti-theft device employs a plurality of connecting rods capable of extending and retracting to adjust the size of the anti-theft device. However, these anti-theft devices must be assembled prior to use and disassembled when not in use is inconvenient for use.

Accordingly, what is needed is an improved anti-theft device. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an improved anti-theft device is now met by a new, useful, and nonobvious invention.

The present utility model is intended to overcome the deficiencies of the prior art. Specifically, the present invention includes an anti-theft device which may be applied to prevent the theft of outdoor air conditioner units and the like.

The anti-theft device has an enclosed state and a folded state, and comprises at least three side surrounding frames capable of extending and retracting along a width direction. The right edge of a side surrounding frame is rotatably connected to the left edge of a next side surrounding frame, and the left edge of the first side surrounding frame and the right edge of the last side surrounding frame being free edges, wherein when the anti-theft device is in the enclosed state, the left edge of the first side surrounding frame and the right edge of the last side surrounding frame are locked together and a closed area is formed by the side surrounding frames; when the anti-theft device is in the folded state, the at least three side surrounding frames stack on each other.

In an embodiment, the number of the side surrounding frames is an even number.

In an embodiment, the anti-theft device further includes a transverse surrounding frame, capable of extending and retracting along a width direction, that is detachably connected to two opposite side surrounding frames when in the enclosed state.

In an embodiment, one of the opposite two side surrounding frames is provided with a first connecting element and the other one is provided with a lock catch. An end of the transverse surrounding frame is provided with a second connecting element and another end is provided with a lock hook. When the transverse surrounding frame and the side surrounding frames are in a connected and locked state, the first connecting element is connected with the second connecting element, and the lock hook hooks the lock catch.

In an embodiment, the side surrounding frame provided with the first connecting element is provided with a stop block for preventing the first connecting element and the second connecting element from disengaging when in the connected and locked state.

In an embodiment, the transverse surrounding frame comprises at least two sections of transverse surrounding supports successively sleeved in the width direction.

In an embodiment, each of the side surrounding frames comprises at least two sections of side surrounding supports successively sleeved in the width direction.

In an embodiment, a disengaging prevention element is provided on the side surrounding supports for preventing the side surrounding supports sleeved together from disengaging.

In an embodiment, a burglar mesh is provided on the side surrounding frames.

In an embodiment, an upper surrounding frame is connected above the side surrounding frames, is capable of telescoping up and down, and is able to extend and retract along the width direction.

In an embodiment, two ends of the side surrounding frames have a hollow side support provided along the up and down direction, inside which the upper surrounding frame is slidably provided.

In an embodiment, a position limiting part is provided between the side surrounding supports and the upper surrounding frame for preventing the upper surrounding frame from disengaging from the side surrounding supports. In addition, a fixing part is provided between the side surrounding supports and the upper surrounding frame for fixing the side surrounding supports and the upper surrounding frame.

In an embodiment, a leg is connected at the bottom of the side surrounding frames rotatable by taking the connecting point with the side surrounding frames as a turning point.

In an embodiment, the left edge of the first side surrounding frame is connected with a left locking edge and the right edge of the last side surrounding frame is connected with a right locking edge. Moreover, the left locking edge and the right locking edge both are provided with lock holes.

In an embodiment, an angled first lock sheet is horizontally provided between the left edge of the first side surrounding frame and the left locking edge, and a quadrate second lock sheet is provided between the right edge of the last side surrounding frame and the right locking edge. The second lock sheet is located above or below the first lock sheet and fits closely with the first lock sheet when the left edge of the first side surrounding frame and the right edge of the last side surrounding frame are locked.

By rotatably connecting these side surrounding frames, extending and retracting these side surrounding frames when in use, and by contracting and folding them when not in use, the present utility model is more convenient to use than the existing anti-theft devices, and has a very simple structure.

An embodiment of the present invention includes a method of enclosing an outdoor air conditioner unit. The method includes unfolding a plurality of side surrounding frames arranged in a series. The plurality of side surrounding frames includes each of the side surrounding frames having an adjustable width and each side surrounding fame being permanently and rotatably secured to an adjacently arranged side surrounding frame in the plurality of side surrounding frames, with the exception of a first and a last side surrounding frame. The first side surrounding frame has a free end that is opposite an end that is permanently and rotatably secured to one of the adjacently arranged side surrounding frames. Likewise, the last side surrounding frame has a free end that is opposite an end that is permanently and rotatably secured to one of the adjacently arranged side surrounding frames.

The method further includes arranging the plurality of side surrounding frames around the outdoor air conditioner unit and adjusting the width of each side surrounding frame such that its respective width is greater than a width of an adjacently located side of the outdoor air conditioner unit. Then the free end of the first side surrounding frame is locked to the free end of the last side surrounding frame to enclose the outdoor air conditioner unit within the plurality of side surrounding frames.

In an embodiment, the method further includes permanently securing each of the plurality of the side surrounding frames, with the exception of the first and last side surrounding frame, to a ground surface on which the outdoor air conditioner unit resides. In an embodiment, the plurality of side surrounding frames includes an even number of side surrounding frames. In an embodiment, feet are rotatably secured to the side surrounding frames at the permanent interconnection points and those feet are secured to the ground surface. For example, if there are four side surrounding frames, there would be three feet secured to the ground and the foot located at the interconnection point of the free ends of the first and last side surrounding frames is not permanently secured to the ground. As a result, both the first and last side surrounding frames can pivot open to provide access to the air conditioner unit when the other sides surrounding frames are secured in place via the feet secured to the ground surface.

An embodiment of the method further includes attaching a transverse surrounding frame having an adjustable width to a top side of at least two oppositely arranged side surrounding frames in the plurality of side surrounding frames when the anti-theft device is in the enclosed state, such that the transverse surrounding provides at least a partial upper cover over the closed-in area. An embodiment further includes securing a first connecting element on a first end of the transverse surrounding frame to a second connecting element on a top rail of one of the plurality of side surrounding frames; and securing a lock hook on a second end of the transverse surrounding frame to a lock catch on a top rail of an oppositely arranged side surrounding frame.

In an embodiment, the side surrounding frame having the first connecting element further includes a stop block for preventing the first connecting element and the second connecting element from disengaging when in a connected and locked state.

In an embodiment, the transverse surrounding frame includes at least two sections of transverse surrounding supports successively sleeved in the width direction.

In an embodiment, each of the side surrounding frames includes at least two sections of side surrounding supports successively sleeved in a width direction.

In an embodiment, the method includes securing a burglar mesh on the side surrounding frames. An embodiment may also include adjusting a height of each of the plurality of side surrounding frames to be greater than a height of the outdoor air conditioner unit, wherein each of the plurality of side surrounding frames includes an upper portion having an adjustable width and being adapted to telescope upwards and downwards from the side surrounding frame.

An embodiment of the anti-theft device includes a plurality of sides surrounding frames arranged in a series, each of the side surrounding frames having an adjustable width. Each side surrounding fame is rotatably secured to an adjacently arranged side surrounding frame in the plurality of side surrounding frames, with the exception of a first and a last side surrounding frame. The first side surrounding frame has a free end that is opposite an end that is rotatably secured to one of the adjacently arranged side surrounding frames. The last side surrounding frame having a free end that is opposite an end that is rotatably secured to one of the adjacently arranged side surrounding frames and the free end of the first side surrounding frame and the free end of the last side surrounding frame are temporarily attachable to each other. Each of the plurality of surrounding frames further includes an upper portion having an adjustable width and being adapted to telescope upwards and downwards from the side surrounding frame. Furthermore, the anti-theft device has an enclosed state and a folded state, when in the enclosed state, the free end of the first side surrounding frame and the free end of the last side surrounding frame are locked together and a closed-in area is formed by the plurality of side surrounding frames, and when in the folded state, the plurality of side surrounding frames are folded and stacked on each other.

An embodiment further includes a transverse surrounding frame having an adjustable width. The transverse surrounding frame is secured to a top side of at least two oppositely arranged side surrounding frames in the plurality of side surrounding frames when the anti-theft device is in the enclosed state, such that the transverse surrounding provides at least a partial upper cover over the closed-in area.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
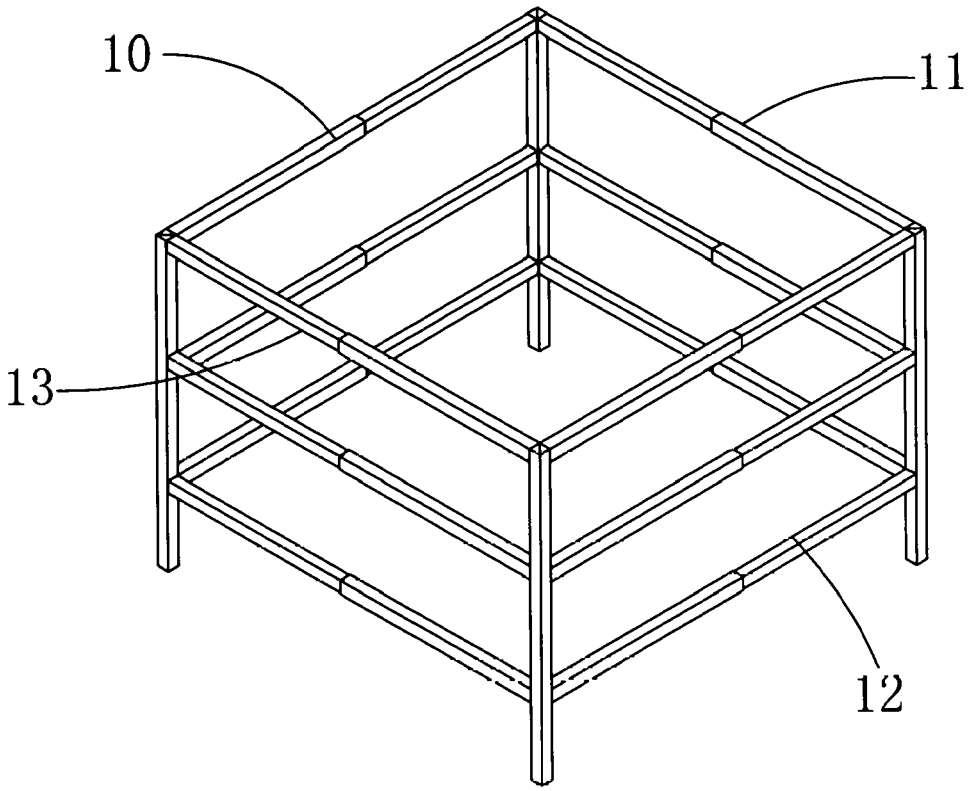
FIG. 1 is a diagram of an enclosed state of Embodiment 1.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

In the following, the preferable embodiments of the present utility model are explained in detail combining with the accompanying drawings.

Embodiment 1

An anti-theft device comprises four side surrounding frames 10, 11, 12 and 13 capable of stretching out and drawing back along a width direction. The right edge of the side surrounding frame 10 and the left edge of the side surrounding frame 11 are rotatably connected, the right edge of the side surrounding frame 11 and the left edge of the side surrounding frame 12 are rotatably connected, and the right edge of the side surrounding frame 12 and the left edge of the side surrounding frame 13 are rotatably connected. The left edge of the side surrounding frame 10 and the right edge of the side surrounding frame 13 are free edges. The rotating manner between the side surrounding frames may employ a pivoting or hinging manner, and the manners capable of achieving the above-mentioned functions should be covered by the scope of the present application.

Figure 2:
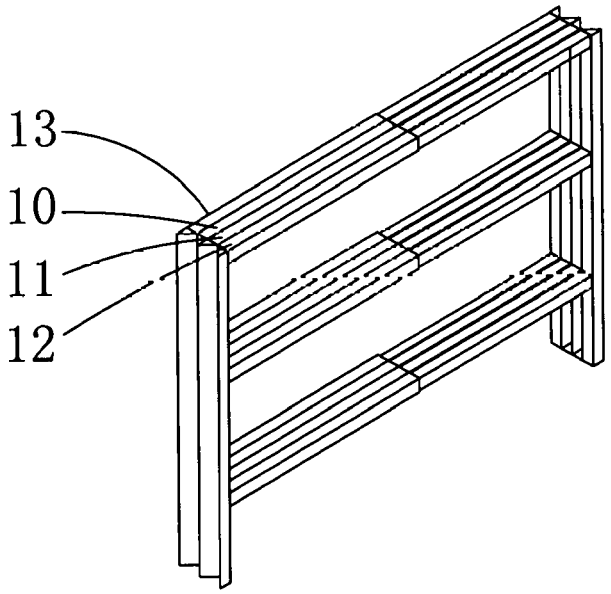
FIG. 2 is a diagram of a folded state of Embodiment 1.
Figure 3:
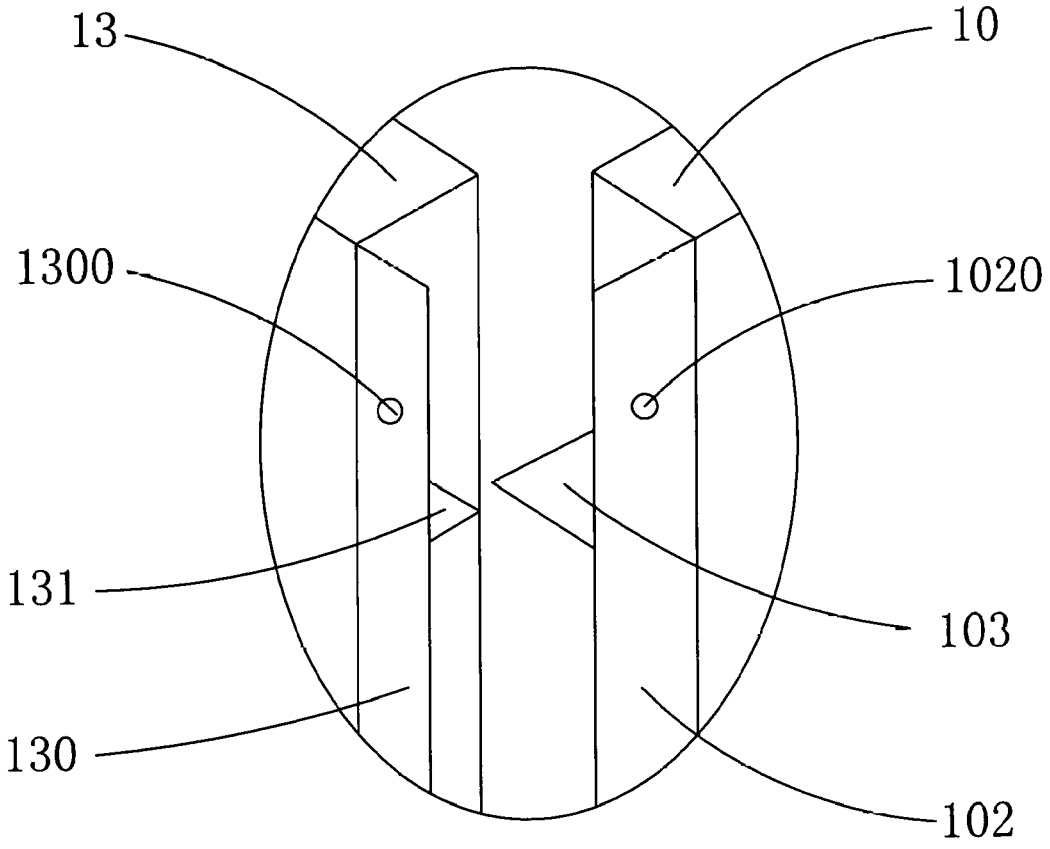
FIG. 3 is a schematic diagram of fitting of the first lock side and the second lock side in Embodiment 1.

As shown in FIGS. 1 and 2, the anti-theft device may be enclosed or folded. When need to be enclosed, the side surrounding frames 10, 11, 12 and 13 are rotated and stretched out, the left edge of the side surrounding frame 10 and the right edge of the side surrounding frame 13 are locked such that the side surrounding frames 10, 11, 12 and 13 are enclosed to form a quadrate closed area. As shown in FIG. 3, the left edge of the side surrounding frame 10 is connected with a left locking edge 102 and the right edge of the side surrounding frame 13 is connected with a right locking edge 130, and the left locking edge 102 and the right locking edge 130 both are provided with lock holes 1020 and 1030. Moreover, an angled first lock sheet 103 is provided between the left edge of the side surrounding frame 10 and the left locking edge 102, and a quadrate second lock sheet 131 is horizontally provided between the right edge of the side surrounding frame 13 and the right locking edge 130.

When the left edge of the side surrounding frame 10 and the right edge of the side surrounding frame 13 are locked, the second lock sheet 131 is inserted above the first lock sheet 103 and fits closely with the first lock sheet 103 such that by locking the lock holes 1020 and 1030 together via a lock, and the first lock sheet 103 and the second lock sheet 131 fitting closely may limit the position in the up and down direction. When need to be folded, by removing the locking of the left edge of the side surrounding frame 10 and the right edge of the side surrounding frame 13, the side surrounding frames 10, 11, 12 and 13 are rotated and can folded, as shown in FIG. 2.

Figure 4:
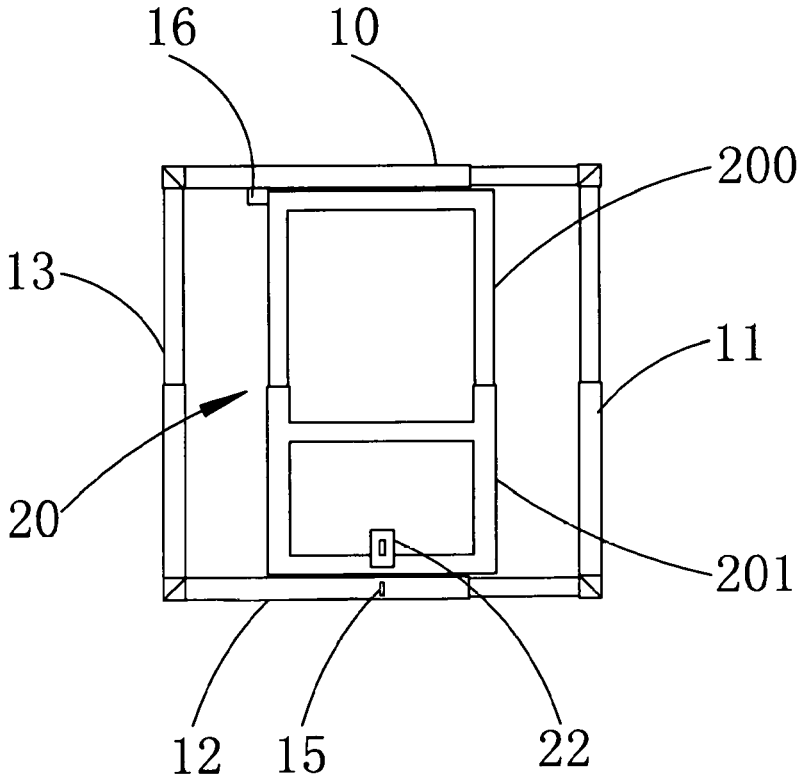
FIG. 4 is a schematic diagram of connecting of the transverse surrounding frames in Embodiment 1.
Figure 5:
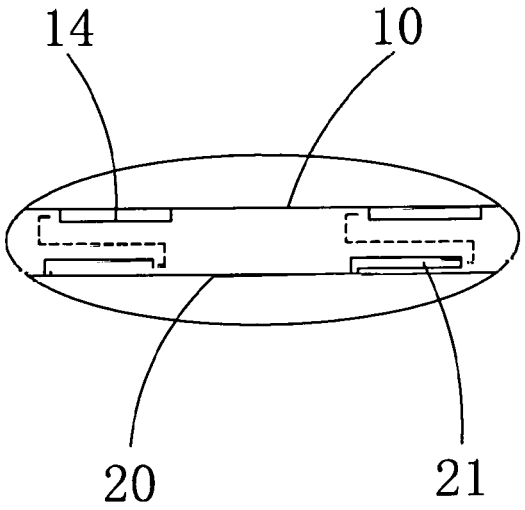
FIG. 5 is a schematic diagram of fitting relationship of the first connecting element and the second connecting element in Embodiment 1.

As shown in FIG. 4, the anti-theft device further comprises a transverse surrounding frame 20 capable of stretching out and drawing back along the width direction, which is detachable connected to two side surrounding frames 10 and 12 or side surrounding frames 11 and 13 which are opposite when in the enclosed state. Taking the side surrounding frames 10 and 12 for example, the side surrounding frame 10 is provided with a first connecting element and the side surrounding frame 12 is provided with a lock catch 15; an end of the transverse surrounding frame 20 is provided with a second connecting element and another end is provided with a lock hook 22. As shown in FIG. 5, the specific connecting manner may be that the first connecting element is a connecting hole 14, and the opening direction of the connecting hole 14 is coincident with the width direction of the side surrounding frame 10 and 12; and the second connecting element is a connecting column 21. In addition, the side surrounding frame 10 is provided with a stop block 16. During installation, the width of the transverse surrounding frame 20 is adjusted to be coincident with the width of the side surrounding frame 11 and 13, the connecting column 21 is inserted into the connecting hole 14, and the lock hook 22 hooks the lock catch 15 by rotating the transverse surrounding frame 20 and locking via a lock. At present, the stop block 16 blocks transverse surrounding frame 20 so as to prevent the connecting column 21 disengaging from the connecting hole 14.

Figure 6:
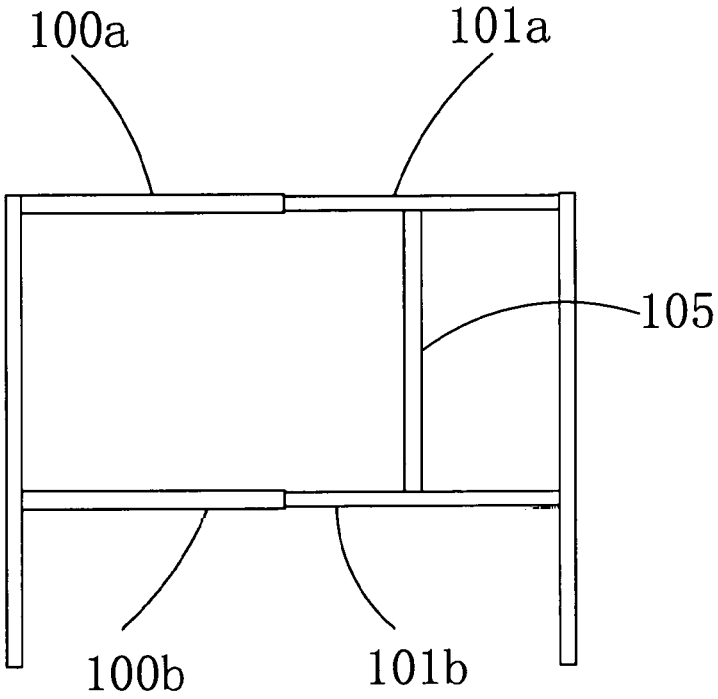
FIG. 6 is a schematic diagram of nesting of the side surrounding frames in Embodiment 1.
Figure 7:
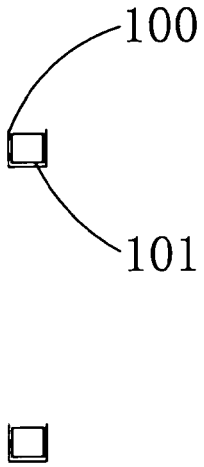
FIG. 7 is a schematic diagram of nesting of the side surrounding supports in Embodiment 1.
Figure 9:
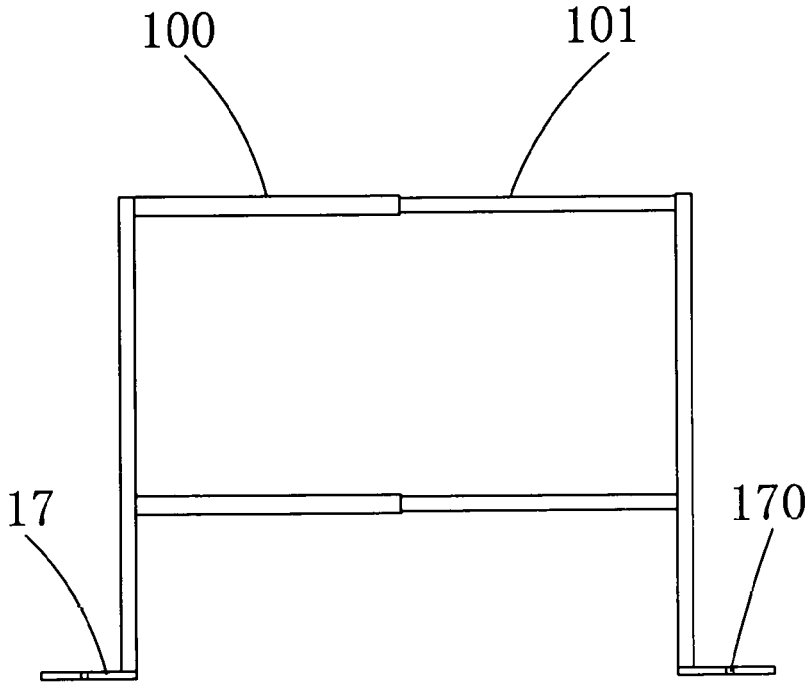
FIG. 9 is another schematic diagram of nesting of the side surrounding frames in Embodiment 1.
Figure 10:
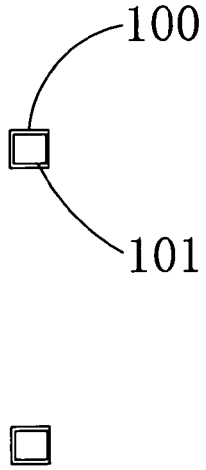
FIG. 10 is another schematic diagram of nesting of the side surrounding supports in Embodiment 1.
Figure 11:
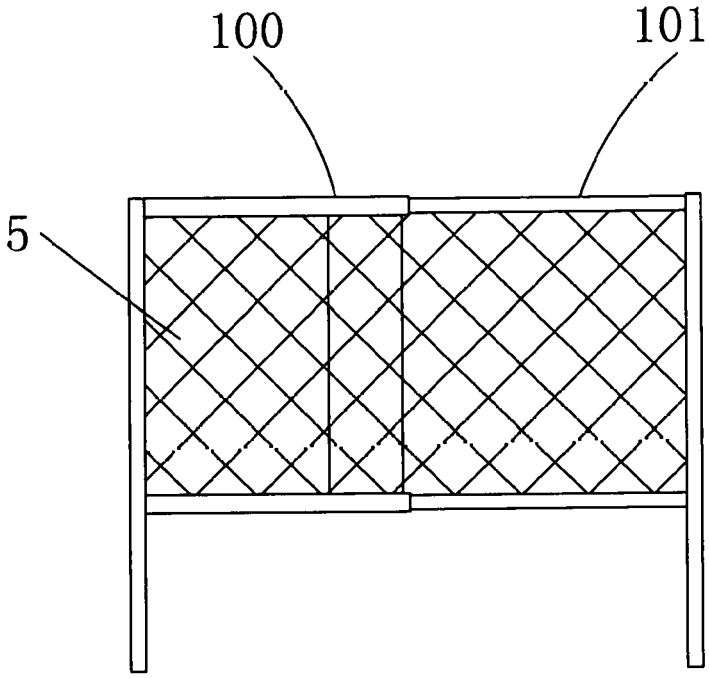
FIG. 11 is a schematic diagram of nesting of the side surrounding frames in Embodiment 2.
Figure 12:
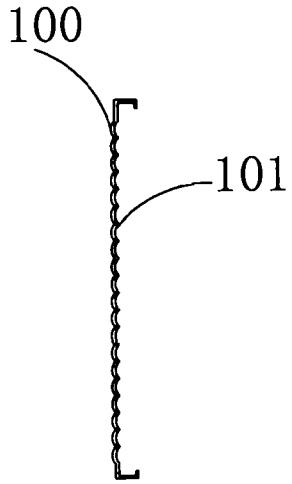
FIG. 12 is a schematic diagram of nesting of the side surrounding supports in Embodiment 2.

In this embodiment, the side surrounding frames 10, 11, 12 and 13 comprise two sections of side surrounding supports sleeved together in the width direction. Taking the side surrounding frame 10 for example, the side surrounding frame 10 comprises side surrounding supports 100 *a*, 100 *b*, 101 *a* and 101 *b*, wherein the side surrounding supports 100*a* and 100*b* are sleeved outside of the side surrounding supports 101*a* and 101 *b*, and the sleeving structure may employ a tube-shaped nesting manner, the section of the structure where nesting is closed such as a hollow square shape as shown in FIGS. 9 and 10, or non-closed such as a U-shape as shown in FIGS. 6 and 7. The width of the side surrounding frames 10 is adjusted by stretching the side surrounding support 101 into the side surrounding support 100 or drawing back the side surrounding support 101. Moreover, a strengthen part 105 is provided between the side surrounding supports 100*a* and 100*b*, extending along the vertical direction.

Figure 8:
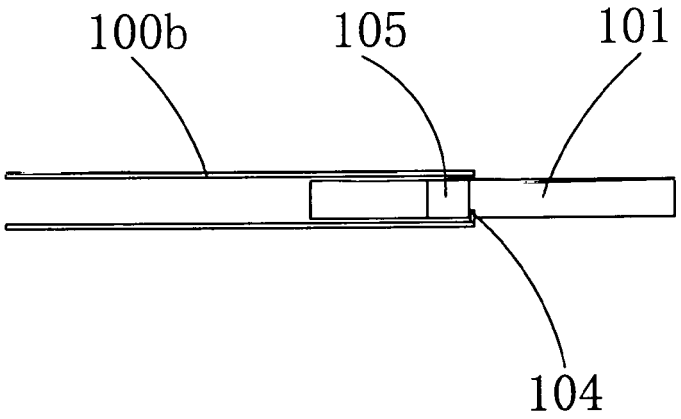
FIG. 8 is a schematic diagram of setting of the disengaging prevention element in Embodiment 1.

A disengaging prevention element is provided on the side surrounding supports for preventing the side surrounding supports sleeved together from disengaging. As shown in FIGS. 6-8, a specific embodiment of the disengaging prevention element is illustrated as follow: the side surrounding supports 100*a*, 100*b*, 101*a* and 101*b* employ a nesting manner with U-shaped section, and the strengthen part 105 is provided between the side surrounding supports 101*a* and 101*b*; a disengaging prevention hook 104 is provided at an end part of the side surrounding support 100*b* such that the side surrounding supports 101*a* and 101*b* cannot be pulled out any more when the disengaging prevention hook 104 hooks the strengthen part 105 to achieve the position limit and disengaging prevention effects. The position of the strengthen part 105 is determined by the requirement of the width when stretching out and drawing back.

Similarly, the transverse surrounding frame 20 comprises two sections of transverse surrounding supports 200 and 201 sleeved together in the width direction, which may also employ the nesting structure of the side surrounding supports 100 and 101.

Furthermore, a plurality of legs 17 is connected at the bottom of the side surrounding frames 10, 11, 12 and 13, and legs 17 may rotate by taking the connecting points with the side surrounding frames 10, 11, 12 and 13 as a turning points to increase the supporting stability. Holes 170 may be opened on legs 17 for fixing on the ground.

Embodiment 2

This embodiment is basically the same with Embodiment 1 by differing in that a burglar mesh 5 is provided on the side surrounding frames 10, 11, 12 and 13, for example a metal mesh. Similarly, the side surrounding frame 10, 11, 12 and 13 comprise two sections of side surrounding supports sleeved together in the width direction, which employ a L-shaped nesting manner due to that the tube-shaped nesting manner of Embodiment 1 is not suitable for installing a burglar mesh. Taking the side surrounding frame 10 for example, the side surrounding frame 10 comprises side surrounding supports 100 and 101, wherein the upper and lower sections of the side surrounding supports 100 and 101 are symmetrical L-shaped structures between which the burglar mesh 5 is installed, and the side surrounding supports 100 is sleeved outside the side surrounding supports 101 to implement stretching out and drawing back. Other nesting manner capable of installing the burglar mesh 5 and implementing stretching out and drawing back may also be employed.

Embodiment 3

Figure 13:
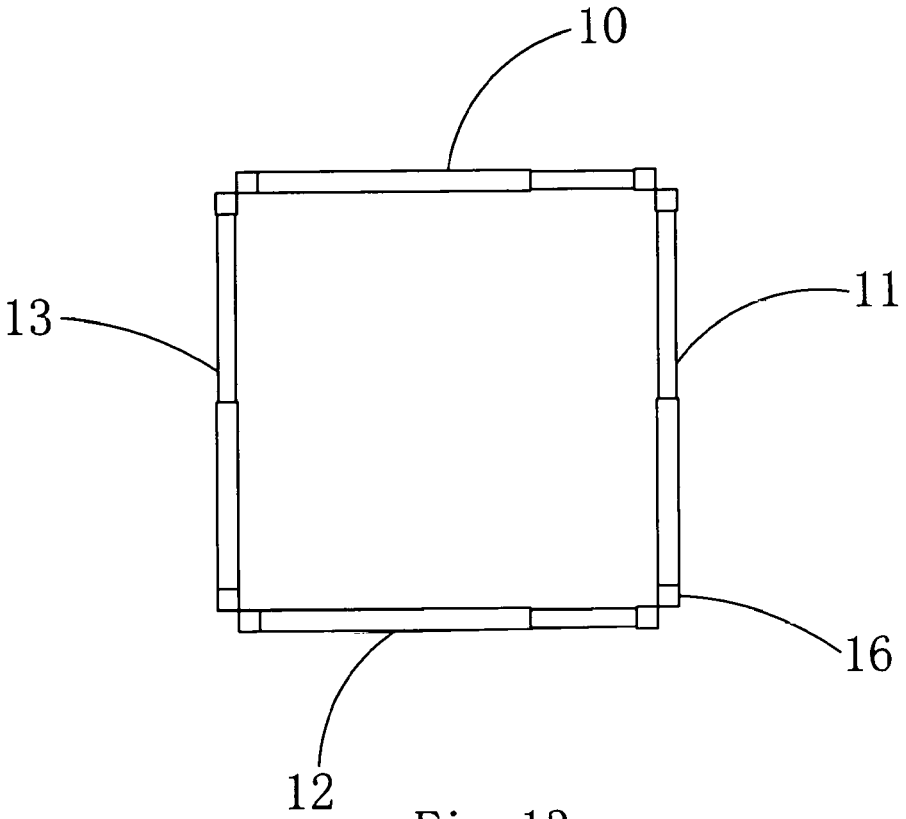
FIG. 13 is a top view of the side surrounding frames in Embodiment 3.
Figure 14:
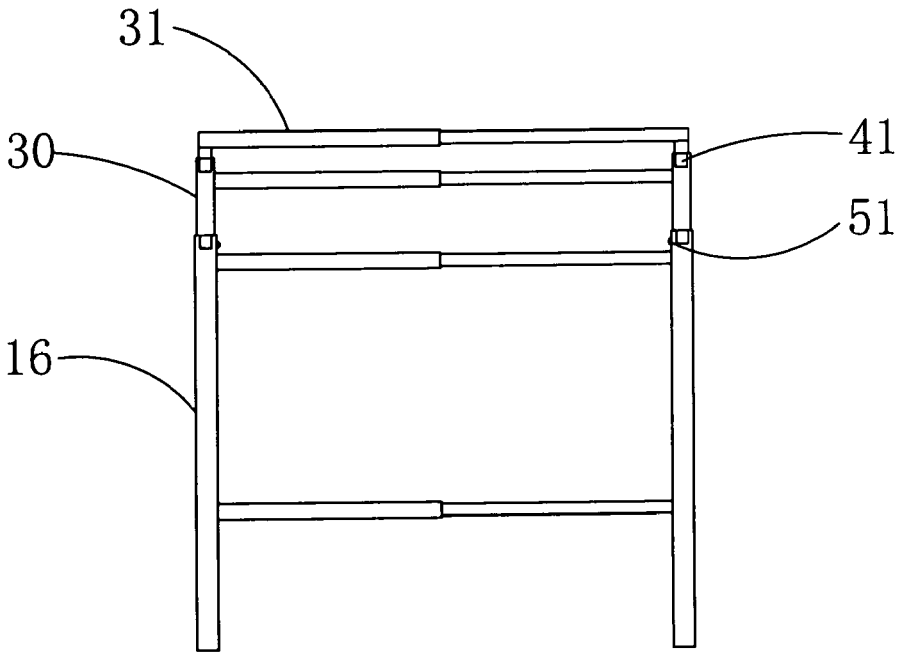
FIG. 14 is a main view of Embodiment 3.

This embodiment is substantially the same with Embodiment 1 and Embodiment 2 by differing in that, as shown in FIGS. 13 and 14, an upper surrounding frame 30 over the side surrounding frames 10, 11, 12 and 13 is connected capable of expanding up and down, which is also able to stretch out and draw back in the width direction. The upper surrounding frame 30 may also employ a tube-shaped nesting manner and the same nesting structure may be applied on the upper surrounding frame 30. The defined structure is as follow:

two ends of the side surrounding frames 10, 11, 12 and 13 have side supports 16 which are hollow along the up and down direction and inside which the upper surrounding frame 30 are slidably provided, that is, a tube-shaped nesting manner is employed.

Furthermore, between the side surrounding support 16 and the upper surrounding frame 30, a position limiting part is provided for preventing the upper surrounding frame 30 from disengaging from the side surrounding support 16, and a fixing part is provided for fixing the side surrounding support 16 and the upper surrounding frame 30.

Figure 15:
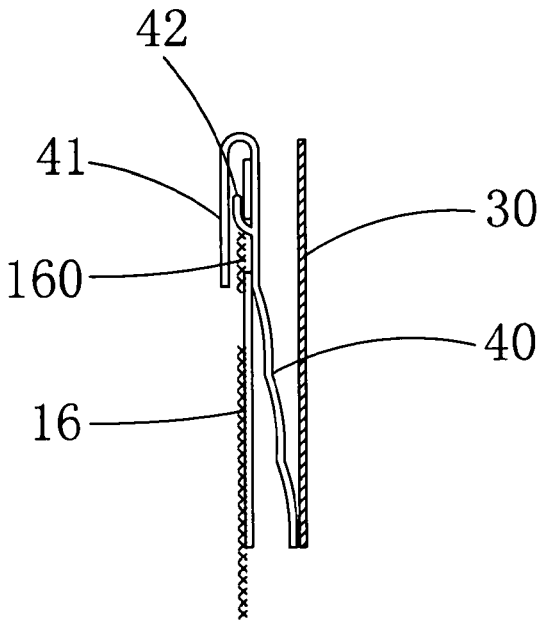
FIG. 15 is a schematic diagram of connecting of the position limiting part in Embodiment 3.

As shown in FIG. 15, the position limiting part is a limiting elastic piece having a main body 40 with a wave-shape. A bend portion 41 is formed by bending an end of the main body 40 towards one side and a tongue portion 42 is provided on the main body 40 extending towards between the main body 40 and the bend portion 41. A hole 160 is opened at an upper end part of the side surrounding support 16, and the bend portion 41 hooks the upper edge of the side surrounding support 16 such that the tongue portion 42 is stuck in the hole 160 and the wave-shaped main body 40 is located between the side surrounding support 16 and the upper surrounding frame 30. In this way, the wave shaped main body 40 increases the friction between the side surrounding support 16 and the upper surrounding frame 30 such that the upper surrounding frame 30 is hard to disengage from the upper surrounding frame 30, and the tongue portion 42 stuck in the hole 160 may also avoid the limiting elastic piece from being taken out.

Figure 16:
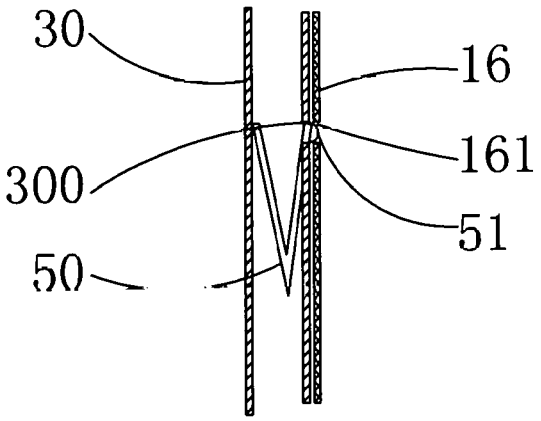
FIG. 16 is a schematic diagram of connecting of the fixing part in Embodiment 3.

As shown in FIG. 16, the fixing part is a V-shaped elastic piece having a V-shaped main body 50, and an end part of the main body 50 have a raised portion 51 protruding outside. A hole 161 is opened on the side surrounding support 16, and a hole 300 is opened on the upper surrounding frame 30. The V-shaped main body 50 is provided inside the upper surrounding frame 30, and the raised portion 51 is stuck in the hole 300. When moving the upper surrounding frame 30, the raised portion 51 may be stuck in the hole 161 of the upper surrounding frame 30 such that the side surrounding support 16 and the upper surrounding frame 30 are fixed to each other; and when the raised portion 51 is pressed to be disengaged from the hole 161 of the upper surrounding frame 30, the side surrounding support 16 and the upper surrounding frame 30 may stretch out and draw back relative to each other.

The embodiments described above are only for illustrating the technical concepts and features of the present utility model, and intended to make those skilled in the art being able to understand the present utility model and thereby implement it, and should not be concluded to limit the protective scope of this utility model. Any equivalent variations or modifications according to the spirit of the present utility model should be covered by the protective scope of the present utility model.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A method of enclosing an outdoor air conditioner unit, comprising:

unfolding a plurality of side surrounding frames arranged in a series, wherein the plurality of side surrounding frames includes:

each of the side surrounding frames having an adjustable width and each side surrounding fame being permanently and rotatably secured to an adjacently arranged side surrounding frame in the plurality of side surrounding frames, with the exception of a first and a last side surrounding frame;

the first side surrounding frame having a free end that is opposite an end that is permanently and rotatably secured to one of the adjacently arranged side surrounding frames;

the last side surrounding frame having a free end that is opposite an end that is permanently and rotatably secured to one of the adjacently arranged side surrounding frames;

arranging the plurality of side surrounding frames around the outdoor air conditioner unit and adjusting the width of each side surrounding frame such that its respective width is greater than a width of an adjacently located side of the outdoor air conditioner unit; and locking the free end of the first side surrounding frame to the free end of the last side surrounding frame to enclose the outdoor air conditioner unit within the plurality of side surrounding frames.

2. The method of claim 1, further including permanently securing each of the plurality of the side surrounding frames, with the exception of the first and last side surrounding frame, to a ground surface on which the outdoor air conditioner unit resides.

3. The method of claim 1, wherein the plurality of side surrounding frames includes an even number of side surrounding frames.

4. The method of claim 1, further including attaching a transverse surrounding frame having an adjustable width to a top side of at least two oppositely arranged side surrounding frames in the plurality of side surrounding frames when the anti-theft device is in the enclosed state, such that the transverse surrounding provides at least a partial upper cover over the closed-in area.

5. The method of claim 4, further including:

securing a first connecting element on a first end of the transverse surrounding frame to a second connecting element on a top rail of one of the plurality of side surrounding frames; and securing a lock hook on a second end of the transverse surrounding frame to a lock catch on a top rail of an oppositely arranged side surrounding frame.

6. The method of claim 1, wherein the side surrounding frame having the first connecting element further includes a stop block for preventing the first connecting element and the second connecting element from disengaging when in a connected and locked state.

7. The method of claim 4, wherein the transverse surrounding frame includes at least two sections of transverse surrounding supports successively sleeved in the width direction.

8. The method of claim 1, wherein each of the side surrounding frames includes at least two sections of side surrounding supports successively sleeved in a width direction.

9. The method of claim 1, securing a burglar mesh on the side surrounding frames.

10. The method of claim 1, further including adjusting a height of each of the plurality of side surrounding frames to be greater than a height of the outdoor air conditioner unit, wherein each of the plurality of side surrounding frames includes an upper portion having an adjustable width and being adapted to telescope upwards and downwards from the side surrounding frame.

11. A method of enclosing an outdoor air conditioner unit, comprising:

unfolding a plurality of side surrounding frames arranged in a series, wherein the plurality of side surrounding frames includes:

each of the side surrounding frames having an adjustable width and each side surrounding fame being permanently and rotatably secured to an adjacently arranged side surrounding frame in the plurality of side surrounding frames, with the exception of a first and a last side surrounding frame;

the first side surrounding frame having a free end that is opposite an end that is permanently and rotatably secured to one of the adjacently arranged side surrounding frames;

the last side surrounding frame having a free end that is opposite an end that is permanently and rotatably secured to one of the adjacently arranged side surrounding frames;

arranging the plurality of side surrounding frames around the outdoor air conditioner unit and adjusting the width of each side surrounding frame such that its respective width is greater than a width of an adjacently located side of the outdoor air conditioner unit;

permanently securing each of the plurality of the side surrounding frames, with the exception of the first and last side surrounding frame, to a ground surface on which the outdoor air conditioner unit resides; and locking the free end of the first side surrounding frame to the free end of the last side surrounding frame to enclose the outdoor air conditioner unit within the plurality of side surrounding frames.

12. The method of claim 11, wherein the plurality of side surrounding frames includes an even number of side surrounding frames.

13. The method of claim 11, further including attaching a transverse surrounding frame having an adjustable width to a top side of at least two oppositely arranged side surrounding frames in the plurality of side surrounding frames when the anti-theft device is in the enclosed state, such that the transverse surrounding provides at least a partial upper cover over the closed-in area.

14. The method of claim 13, further including:

securing a first connecting element on a first end of the transverse surrounding frame to a second connecting element on a top rail of one of the plurality of side surrounding frames; and securing a lock hook on a second end of the transverse surrounding frame to a lock catch on a top rail of an oppositely arranged side surrounding frame.

15. The method of claim 11, wherein the side surrounding frame having the first connecting element further includes a stop block for preventing the first connecting element and the second connecting element from disengaging when in a connected and locked state.

16. The method of claim 11, further including adjusting a height of each of the plurality of side surrounding frames to be greater than a height of the outdoor air conditioner unit, wherein each of the plurality of side surrounding frames includes an upper portion having an adjustable width and being adapted to telescope upwards and downwards from the side surrounding frame.

17. An anti-theft device, comprising:

a plurality of sides surrounding frames arranged in a series, each of the side surrounding frames having an adjustable width;

each side surrounding fame being rotatably secured to an adjacently arranged side surrounding frame in the plurality of side surrounding frames, with the exception of a first and a last side surrounding frame;

the first side surrounding frame having a free end that is opposite an end that is rotatably secured to one of the adjacently arranged side surrounding frames;

the last side surrounding frame having a free end that is opposite an end that rotatably secured to one of the adjacently arranged side surrounding frames;

the free end of the first side surrounding frame and the free end of the last side surrounding frame being temporarily attachable to each other;

each of the plurality of surrounding frames further includes an upper portion having an adjustable width and being adapted to telescope upwards and downwards from the side surrounding frame; and the anti-theft device having an enclosed state and a folded state, when in the enclosed state, the free end of the first side surrounding frame and the free end of the last side surrounding frame are locked together and a closed-in area is formed by the plurality of side surrounding frames, and when in the folded state, the plurality of side surrounding frames are folded and stacked on each other.

18. The anti-theft device according to claim 17, further including a transverse surrounding frame having an adjustable width, the transverse surrounding frame secured to a top side of at least two oppositely arranged side surrounding frames in the plurality of side surrounding frames when the anti-theft device is in the enclosed state, such that the transverse surrounding provides at least a partial upper cover over the closed-in area.

* * * * *